United States Patent [19]

Schroeder

[11] 4,268,746

[45] May 19, 1981

[54] DOCUMENT FEED JAM DETECTOR FOR A DOCUMENT READING APPARATUS

[75] Inventor: Dale W. Schroeder, Iowa City, Iowa

[73] Assignee: Westinghouse Electric Corp., Pittsburgh, Pa.

[21] Appl. No.: 88,305

[22] Filed: Oct. 25, 1979

[51] Int. Cl.[3] ..... B65H 7/00

[52] U.S. Cl. ..... 250/223 R; 271/259; 340/674

[58] Field of Search ..... 250/223 R; 271/259, 271/258; 340/674, 675

[56] References Cited

U.S. PATENT DOCUMENTS 3,603,680 9/1971 Barton .
3,778,629 12/1973 Terryn .
4,026,543 5/1977 Lechere .

*Primary Examiner*—David C. Nelms
*Assistant Examiner*—Darwin R. Hostetter
*Attorney, Agent, or Firm*—M. P. Lynch

[57] ABSTRACT

The movement of a document through a transport system is simulated electronically and compared to the actual movement of the document to detect a document feed jam.

5 Claims, 1 Drawing Figure

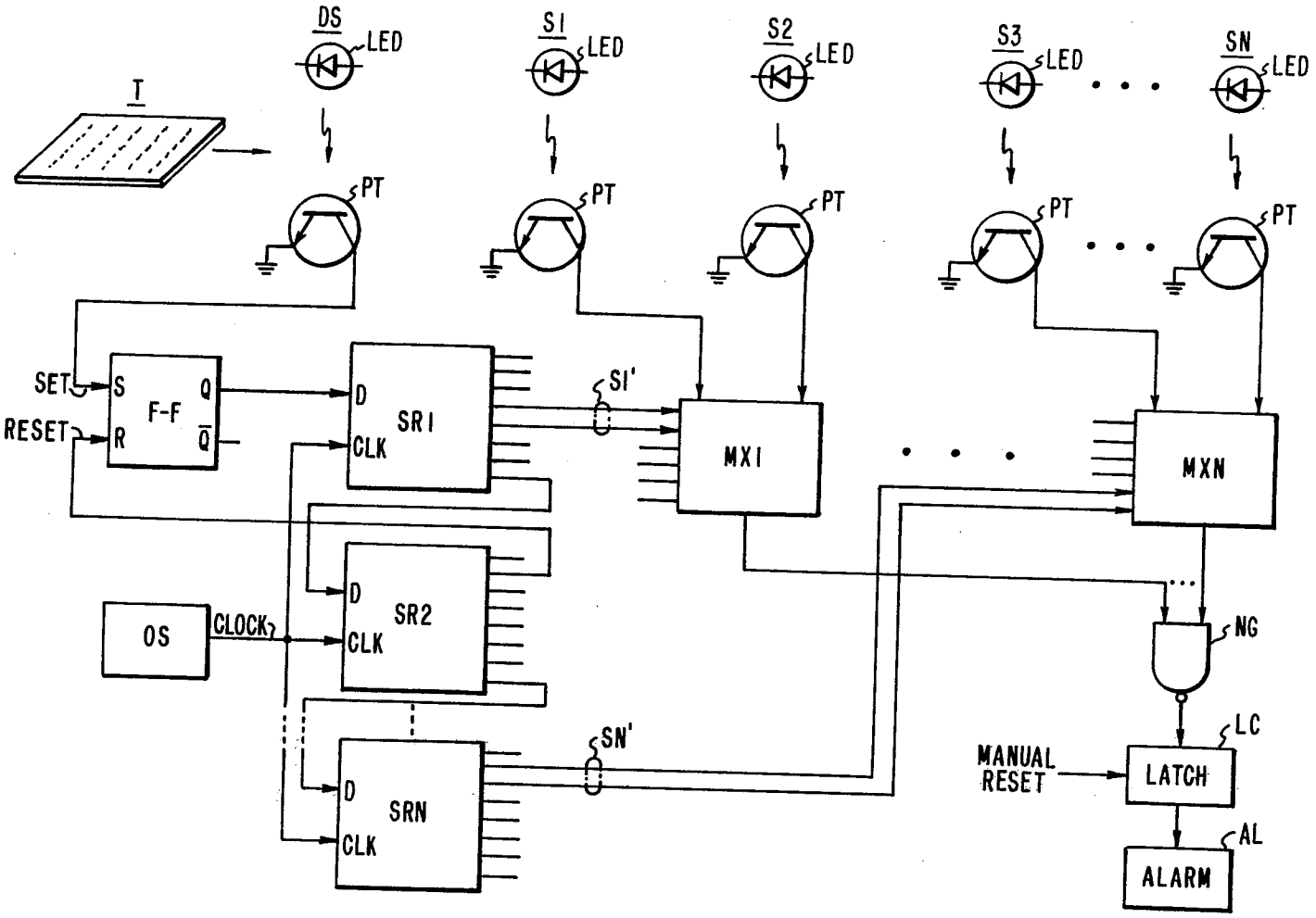
SN
LED
PT
S3
LED
PT
S2
LED
PT
S1
LED
PT
DS
LED
PT
T
MXN
MX1
NG
LC
LATCH
AL
ALARM
MANUAL RESET
S1'
SN'
SR1
D
CLK
SR2
D
CLK
SRN
D
CLK
F-F
S
R
Q
Q̄
SET
RESET
CLOCK
OS

DOCUMENT FEED JAM DETECTOR FOR A DOCUMENT READING APPARATUS

BACKGROUND OF THE INVENTION

The accuracy and validity of a document scanning system requires reliable monitoring of the movement of the document through the transport system which is responsible for moving the document through the optical scanning apparatus. The tracking of the document through the transport of an optical scanning system has typically been accomplished through the use of optical sensors positioned along the transport path in conjunction with a set of timers that function to detect a document jam. This technique is complicated inasmuch as each timer must be adjusted individually, and any change in the transport speed, i.e., the speed of the movement of the document through the system, requires a complete readjustment of all the timers.

SUMMARY OF THE INVENTION

There is disclosed herein with reference to the accompanying drawing a novel electronic technique for simulating the movement of the document through the transport system and comparing the simulated electrical position of the document in the transport system with the actual physical position of the document in the transport system such that any resulting discrepancy between the two provides an indication of a document feed jam condition. The novel system employs a series of shift registers wherein a group of logic 1 bits corresponding to the length of the document is moved through the shift registers at a rate corresponding to the transport speed. A change in the transport speed can be accommodated by merely adjusting a single oscillator which moves the group of logic 1 bits through the shift registers.

Typical document handling and data processing systems employing document transport systems are illustrated and described in U.S. Pat. Nos. 3,050,248 and 3,578,159, which are assigned to the assignee of the present invention and incorporated herein by reference.

DESCRIPTION OF THE DRAWING

The invention will become more readily apparent from the following exemplary description in connection with the accompanying drawing which is a block diagram schematic illustration of a preferred embodiment of the invention.

DESCRIPTION OF THE PREFERRED EMBODIMENT

Referring to the drawing there is schematically illustrated a document transport T employing a document start sensor DS and a plurality of document sensors S1, S2, S3 . . . SN, physically positioned in a spaced-apart relationship along the document travel path of the transport T. Each sensor (S1–SN) produces an output signal indicative of the instant in time when the document D reaches the transport station corresponding to the sensor. The sensors S1–SN are typically illustrated as consisting of a combination of a light emitting diode LED and a photodetector PT. The signal developed by the photodetectors PT are supplied sequentially as input signals to the multiplexer circuits MX1 . . . MXN which may be commercially implemented through the use of a Signetics Multiplexer type 74151.

In addition to the sequential indication of the position of the document along the transport path via the sensors S1, S2, S3 . . . SN, an electronic signal simulating the appropriate position of the document D in the transport T as a function of a predetermined transport speed is developed by the shift registers SR1, SR2 . . . SRN, as clocked by the oscillator circuit OS.

The shift registers illustrated are typically a Signetics type 74164 with each having 8 outputs. The number of shift registers employed is a function of the physical length of the transport T through which the document D travels. Assuming the use of the illustrated shift registers employing 8 outputs and a transport speed making a 1 bit movement in the shift register equivalent to one inch of transport length then a 40 inch long transport would require 5 shift registers of 8 outputs. Those outputs of the shift registers SR1, SR2 . . . SRN, which are selected as inputs to the multiplexer circuits MX1, MXN correspond to the shift register bit locations equivalent to the locations of the sensors S1, S2, S3 . . . SN. The remaining outputs of the shift registers are unused. Thus the outputs S1' of the shift register SR1 are the electronic equivalent of the physical position of the sensor S1 and the shift register outputs SN' of shift register SRN are equivalent in time to the physical position of the sensor SN. Assuming that the length L of the document D corresponds to 10 bits of the shift registers, the flip-flop circuit FF responds to a set input from the document start detector DS, which is indicative of the entry of the document D in the transport T, by activating the input to the shift register SR1. The oscillator circuit OS clocks logic 1 bits through the 8 stages of the shift register SR1 and the first and second stage of the SR2, for a total of 10 bits, or one document length, at which time the second output of the shift register SR2 resets the flip-flop circuit FF. The oscillator OS continues to move the 10 bit document package through the shift registers at a rate which is preset to correspond to the rate at which the document D is fed through the transport T. In the event the output signal of the sensors S1, S2, S3 . . . SN do not correspond in time to the corresponding output of the shift registers as determined by the multiplexer circuits MX1 . . . MXN a document feed jam signal is gated through the NAND gate NG to a latch circuit LC. The output of the latch circuit LC activates a feed jam alarm AL. The latch circuit LC is manually reset by an operator responding to the feed jam condition. Typically the document feed jam output of the NAND gate would initiate shutdown of the document feed system of the transport T. While a number of multiplexer circuits and shift registers are indicated as being employed, the implementation of the shift register and multiplexing circuit functions is dictated by the length of the specific transport T, the number of sensors employed, and the capacity of available shift registers and multiplexer circuits.

I claim:

1. Apparatus for monitoring the position of a document in a document transport system, comprising:

a plurality of document sensor means positioned in a spaced apart relationship along the path of travel of a document in a document transport system including a document entry sensor for generating a signal indicative of the entry of a document in said transport system;

an electronic circuit means for generating a series of logic outputs corresponding in number to the equivalent length of said document, said electronic circuit means advancing said group of logic outputs at a rate corresponding to the rate at which said document is moved through said document transport system; and comparator means operatively connected to said spaced apart sensors and said electronic circuit means to generate an output signal in the event the actual position of said document as monitored by said document sensor means differs from the simulated document position developed by said electronic circuit means.

2. The apparatus as claimed in claim 1 further including a document jam indicator circuit responding to the output from said comparator circuit means to manifest a document jam condition.

3. The apparatus as claimed in claim 1 wherein said electronic circuit means includes a shift register means, an oscillator circuit means providing clock input signals to said shift register means, and drive input circuit means operatively connected to said shift register means to provide logic inputs to said shift register means in response to the entry of a document in said transport system as monitored by said document entry sensor, said document entry sensor initiating said logic inputs at the beginning of a document and said shift register means terminating said logic inputs after a predetermined number of logic inputs equivalent to the length of the document, said oscillator circuit clocking the group of logic inputs corresponding to said document through said shift register means at a rate corresponding to the rate at which said document is transported through said document transport system.

4. The apparatus as claimed in claim 1 wherein said document sensor means each include a combination of a light emitting element and a photodetector.

5. Apparatus as claimed in claim 1 wherein said electronic circuit means generates said logic outputs in response to the output of said document entry sensor.

* * * * *